US005308119A

United States Patent [19]

Roshkoff

[11] Patent Number: 5,308,119

[45] Date of Patent: May 3, 1994

[54] PACKAGING LABEL INCLUDING NEGOTIABLE INSTRUMENT

[75] Inventor: Kenneth S. Roshkoff, Newtown, Pa.

[73] Assignee: Attitude Measurement Corporation, Southampton, Pa.

[21] Appl. No.: 996,255

[22] Filed: Dec. 23, 1992

[51] Int. Cl.[5] ..... B42D 15/00

[52] U.S. Cl. ..... 283/58; 283/56; 283/81; 283/105

[58] Field of Search ..... 253/50, 58, 66.1, 81, 253/105

[56] References Cited

U.S. PATENT DOCUMENTS

| | | | |
|---|---|---|---|
| 1,222,201 | 4/1917 | Glaenzer . | |
| 1,273,105 | 7/1918 | Van Dyke et al. . | |
| 3,858,792 | 1/1975 | Volkert | 283/56 X |
| 4,405,157 | 9/1983 | Bennett | 283/58 |
| 4,592,572 | 6/1986 | Instance | 281/2 |
| 4,621,837 | 11/1986 | Mack | 283/56 X |
| 4,722,554 | 2/1988 | Pettit | 283/56 X |
| 5,137,304 | 8/1992 | Silverschotz et al. | 252/58 X |

OTHER PUBLICATIONS

Brochure for Expanded Contents Labels and Fix-A-Form®, CCL Label, Sioux Falls, South Dakota, publication data unknown.

Samples of Endust® Sweepstakes label and Basis® products label, CCL Label, publication date unknown.

Booklet/Plus TM brochure and samples for DelMonte® Stewed Tomatoes & Chicken and Salem, Mid America Division of Menasha Corp., Neenah, Wis., publication dates unknown.

*Primary Examiner*—Paul A. Bell

*Attorney, Agent, or Firm*—Seidel, Gonda, Lavorgna & Monaco

[57] ABSTRACT

A label for affixing to a container and delivering a foldable document is constructed from an opaque base layer, a folded strip or document, and a transparent outer layer. The outer layer attaches the folded strip or document to the base layer and encloses it between the base layer and outer layer. The outer layer is designed to be severed along one edge so as to allow access to the folded strip or document. The strip or document has at least one line of perforation for separating it into at least two parts. One part is a product information label which forms an outer panel when the strip or document is folded. Another part is a negotiable instrument which is immediately negotiable by either a customer or retailer. The opaque base layer contains indicia which is similar to the product information label, except for some visually noticeable difference. The reverse side of the negotiable instrument contains a questionnaire to be filled out by the customer, thereby providing market research data associated with the customer purchase of a product in the container.

11 Claims, 3 Drawing Sheets

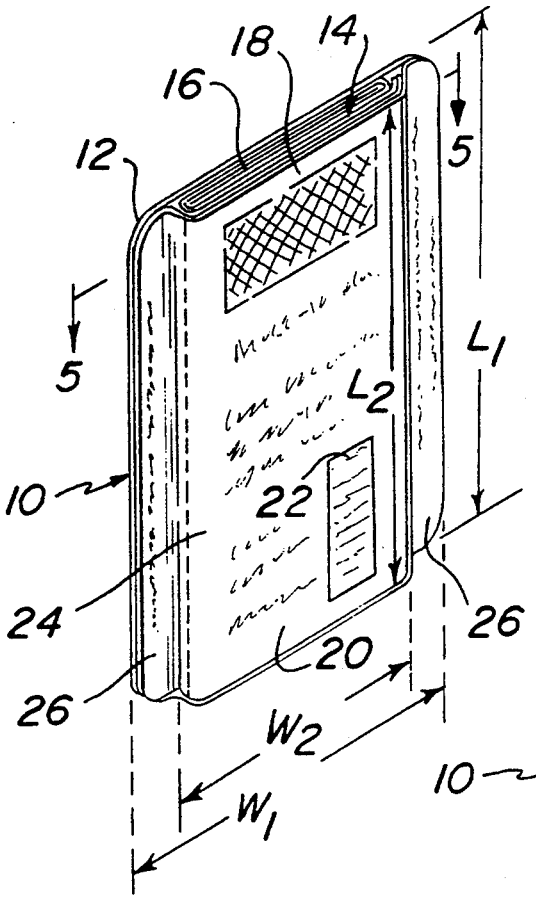
FIG. 1
FIG. 2
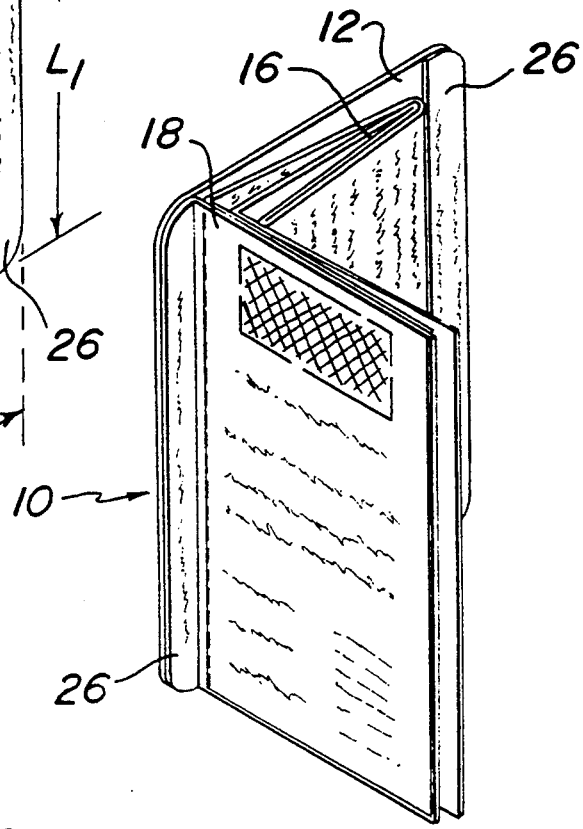
FIG. 3
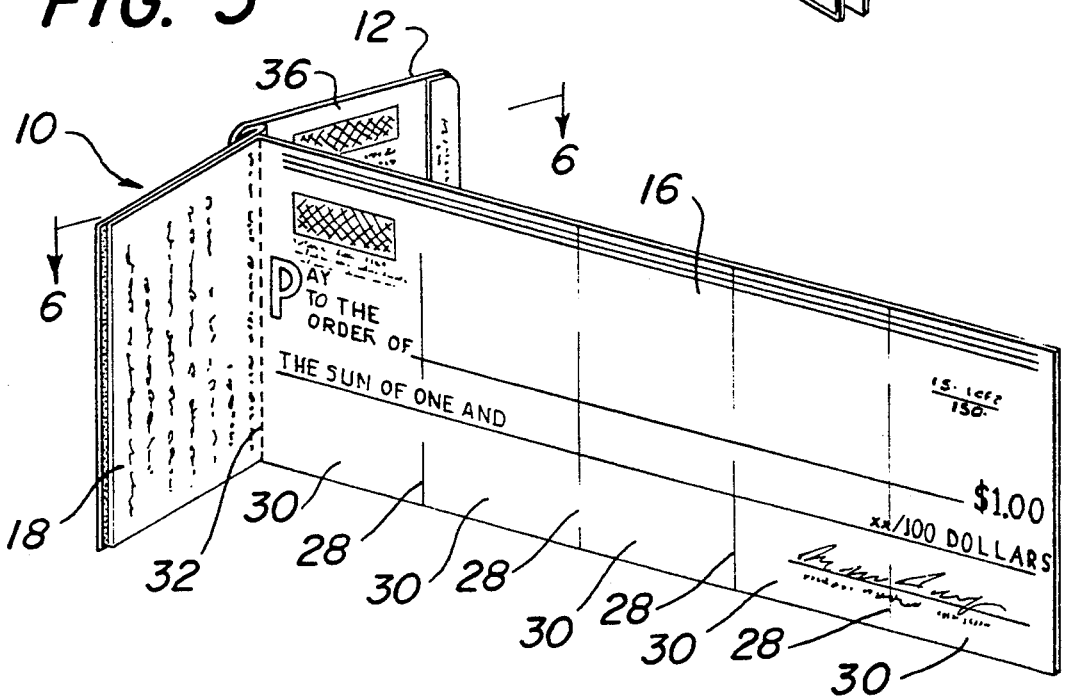

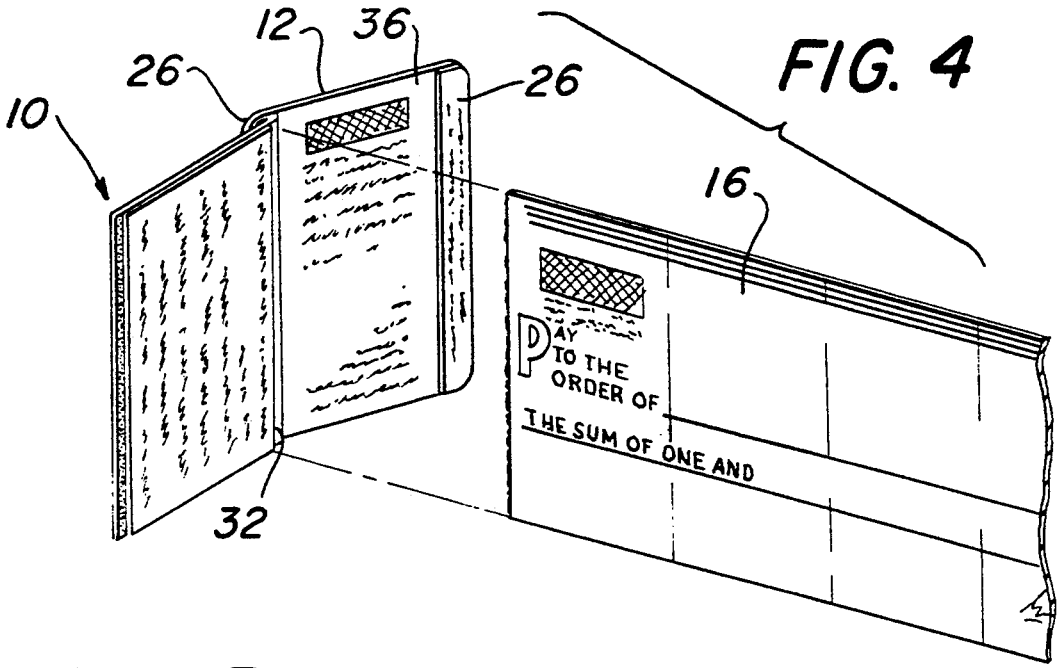
FIG. 4
FIG. 5
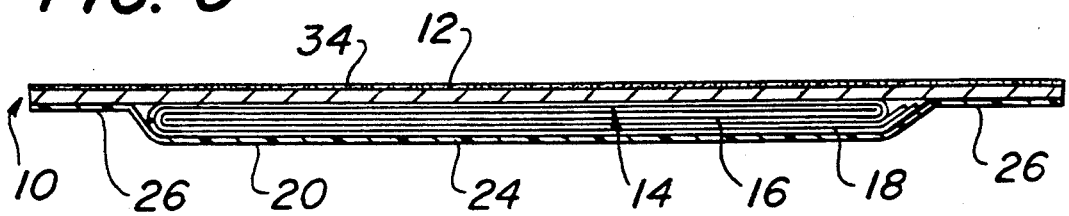
FIG. 6
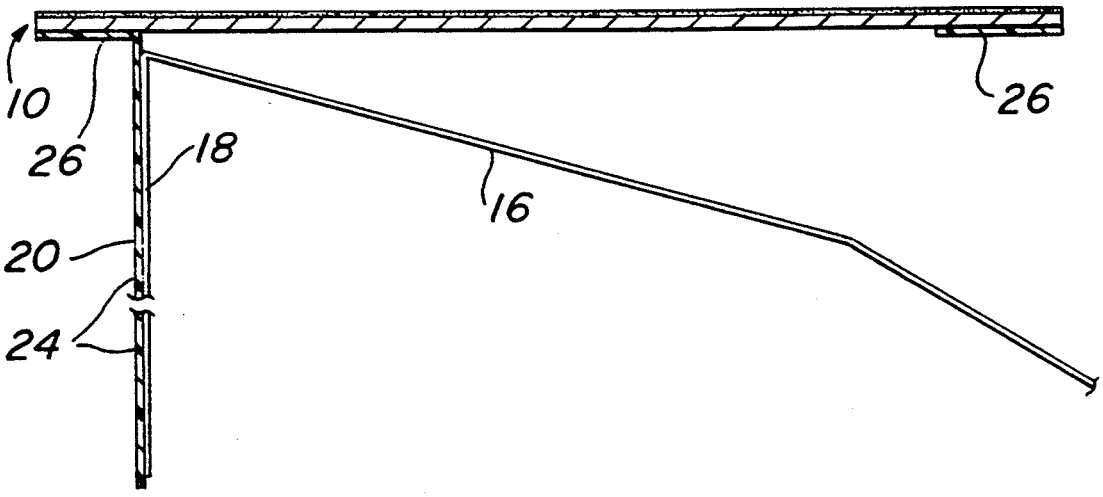

FIG. 7

16

YOUR ENDORSEMENT

SIGNATURE _____
DATE _____
NAME _____
ADDRESS _____
PHONE _____

1. HOW MANY TIMES HAVE YOU PURCHASED THIS PRODUCT X BEFORE ?

_____

2. WHAT WAS YOUR REASON FOR PURCHASING THIS PRODUCT X ?

_____

3. PLEASE INDICATE YOUR AGE GROUP.

☐ ☐ ☐
☐ ☐ ☐

4. HOUSEHOLD INCOME ?

☐ ☐ ☐
☐ ☐ ☐

5. HOW DID YOU HEAR ABOUT PRODUCT X ?

☐ ☐ ☐
☐ ☐ ☐ OTHER. (PLEASE SPECIFY)

_____

6.

PACKAGING LABEL INCLUDING NEGOTIABLE INSTRUMENT

FIELD OF THE INVENTION

This invention relates to a packaging label designed to be on a container at its point of purchase which contains a negotiable instrument therein. The invention is described in the context of, but is not limited to, an expanded contents label wherein part of the expanded label is the negotiable instrument.

BACKGROUND OF THE INVENTION

Packaging labels which include materials of value disposed therein are known in the art. Typically, the material includes coupons, mail-in rebates, sweepstakes entry forms, product literature or related product information. It is also known to use mult-panel labels, expanded content labels or extended content labels to deliver such materials.

Three-layer stick-on lablels for delivering a sweepstakes entry or a rebate coupon on a container are known in the art. These labels consist of a clear base layer for affixing the label to the container, a foldable strip of paper containing product information on one portion and the sweepstakes entry or a rebate coupon on the other portion. A perforation line separates the two portions. A transparent outer layer attaches the foldable strip of paper to the clear base layer and also covers the top-most panel of the folded strip of paper. A customer is instructed to sever one side of the transparent outer layer to gain access to the folded strip of paper. These three-layer stick-on labels have not, heretofore, been employed for delivering negotiable instruments. Furthermore, the use of a clear base layer in these labels renders them unsuitable for such use. Ideally, the customer and/or retailer would like to be alerted if the stick-on container label has been tampered with, for example, by removal of the strip of paper before purchase. However, once the folded strip of paper has been removed from these labels, only an easily overlooked clear base layer remains. The hypothetical use of sweepstakes entry forms or rebate coupons to elicit survey data would be inefficient due to the historically low redemption rate of such forms or coupons, typically less than 10 percent.

The prior art also consists of three-part and two-part (no outer layer) labels for delivering booklets to a customer by attachment to a container. The booklets typically provide information about the product in the container or about something related to the product. Coupons are often provided in the booklet. The booklets are designed either to remain attached to the product or to be removed by the customer after purchase. None of these booklets disclose providing an immediately negotiable instrument therein. Furthermore, these labels do not disclose a survey data questionnaire delivery system.

U.S. Pat. No. 1,273,105 discloses a two-part label. One part, the original label, is permanently attached to a container by an adhesive backing. The other part is for temporary attachment to the container and provides printed material. The purchaser of the container may remove the temporarily attached part and gain access to a paper leaflet attached to it by tearing along a perforated line. The printed matter on the permanent label and temporarily attached label may be duplicates of one another and have delineated thereon the name of the commodity, the maker's name and the like. U.S. Pat. No. 1,273,105 uses an adhesive tab to secure the opening side of the temporary label to the container. This patent does not disclose providing a negotiable instrument with the temporarily attached part of the label nor does it disclose the use of a transparent top layer. Furthermore, it does not disclose a survey data questionnaire delivery system.

U.S. Pat. No. 4,592,572 discloses a foldable strip in which the strip is folded into panels. One panel is permanently attached to the product container. Another panel forms a covering layer, and the remainder of the panels are folded to lie between the panel permanently adhered to the container and the covering label. The panel which forms the covering label also has a portion which is permanently adhered to the underlying container, but which is severable along a line of perforations to provide access to the folded strip. FIG. 3 of U.S. Pat. No. 4,592,572 depicts panel 11 which is permanently attached to support web 26. This patent does not disclose providing a negotiable instrument as part of the label nor does it disclose the use of a transparent top layer. Furthermore, it does not disclose a survey data questionnaire delivery system.

U.S. Pat. No. 4,722,554 discloses a coupon form which includes a check separable from advertising and other materials along a line of perforation. This form is not designed to be affixed to a container nor severed from a portion serving as a product label. Furthermore, the reverse side of the check is not designed to act as a survey data questionnaire.

U.S. Pat. No. 1,222,201 discloses a checkbook in which a negotiable check is removably attached to the binding of a book by perforations. The check is also releasably attached to a permanently-bound stub along a second line of perforations. By tearing along the perforations, the check is separated from the checkbook while the check stub remains permanently attached to the book. The checks in this patent are not designed to be affixed to a container nor severed from a portion serving as a product label. Furthermore, the reverse side of the checks are not designed to act as a survey data questionnaire.

Lastly, U.S. Pat. No. 4,405,157 discloses a check releasably attached to a leaf of a booklet by a line of perforation. The patent describes prior art checks which contain questionnaires on their reverse side, thereby providing an incentive for a customer to provide survey data. The reverse side of the check in U.S. Pat. No. 4,405,157 contains only answer boxes. The questions are provided on other leaves of the booklet. The booklet is not designed to be affixed to a container. Questionnaires printed on the reverse side of checks draw a very high response rate and have proved to be an effective method of collecting survey data. However, the check in U.S. Pat. No. 4,405,157 is not designed to be affixed to a product via a label or associated with a product purchase in any form. Furthermore, the answers to the questions must be either YES or NO. There is no space for filling in answers to open-ended questions via "fill-in-the-blank" type answers. This deficiency significantly reduces its value as a survey tool.

In addition to the disclosure in U.S. Pat. No. 4,405,157, it is known to place questionnaire checks (checks with survey data questions on their reverse side) directly inside a product container. The checks are designed to compensate the customer for their time and energy in answering the survey. In order to gain access to the check, the customer must open the container and remove the check which is mixed in with the container's contents. Such a method has obvious drawbacks. One drawback is that not all products (e.g., ketchup or shampoo) are suitable for insertions of checks in the container. Another drawback is that the insertion step adds to the cost and complexity of packaging. In sum, the delivery of questionnaire checks by prior art methods have disadvantages that limit their application and effectiveness.

It is usually desirable when distributing questionnaire checks via product purchasing to obscure the fact that a valuable check is attached to the product until after the customer has made the purchase. Since these checks are typically used to collect survey data, deliberate purchasing enticements will skew the survey data results. A company that wishes to understand the profile of their customers prefers to discover who is purchasing their products, absent any deliberate enticement to do so. The delivery of questionnaire data to customers in a manner that would both elicit a response without necessarily enticing a purchase and that would also be adaptable to the myriad types of container and products available in retail stores remained, heretofore, an unmet challenge in the prior art.

One problem associated with stick-on labels is that they often obscure product information (e.g., product name, ingredients list, warning instructions) on the original container labels provided by the manufacturer. Such product information is often required by law to be adhered to the container, both before and after purchase or is desired by the customer to be permanently attached after purchase. The obscuring problem is especially serious when the container size is small. Since manufacturers do not usually design their containers and original labels so that additional stick-on labels can be strategically affixed, additional stick-on labels often can only be added if they do not interfere with the original labels. It would be desirable if this deficiency could be overcome, thereby allowing questionnaire checks enclosed within labels to be affixed to containers of both large and small size, and regardless of the layout of the original container label.

In sum, there is still a need for a negotiable document delivery system that is adaptable to the myriad types of containers and products available in retail stores and that would allow delivery of a negotiable document for survey data purposes via a stick-on label in such a manner that would both draw customer attention to the presence of the instrument within the label while not explicitly revealing its presence in a retail store. Furthermore, there is still a need for a label which can provide necessary product labeling information even if the stick-on label covers up all or part of the product container's existing label. The present invention fills those needs.

SUMMARY OF THE INVENTION

The present invention defines a label for affixing to a container having an opaque base layer, a longitudinally foldable strip of paper, and a transparent outer layer. The opaque base layer has an adhesive side for affixing to the container and an imprinting side for printing indicia thereon. The imprinting side has oppositely disposed edges flanked by a product information portion. The longitudinally foldable strip has a perforation running perpendicular to the longitude. The perforation separates the strip into two parts, one part being a negotiable instrument intended to be severed from the strip along the perforation and the other part being a product information label. The stip is folded into a plurality of overlying panels by fold lines with at least a portion of the product information label forming an outer panel. The folded strip overlies the opaque base layer's product information portion. The transparent top layer is permanently attached to at least a part of the strip's outer panel and both oppositely disosed edges of the base layer, thereby attaching the strip to the base layer and enclosing the strip between the top layer and the base layer. The transparent top layer is severable along one edge so as to allow access to the negotiable instrument.

In one embodiment, the reverse side of the negotiable instrument includes questionnaire information.

In another embodiment, the product information portion and the product information label contain substantially similar information, except that the product information label includes a product indentifying bar code which is absent from the product information portion.

In yet another embodiment, the present invention defines a negotiable instrument delivery system and label having an opaque base layer, a foldable document, and a clear upper layer. The opaque base layer has an adhesive side for affixing to the container and an imprinting side for printing indicia thereon. The imprinting side has oppositely disposed edges flanked by a product information portion. The foldable document overlies the base layer's product information portion. The foldable document is separated into at least two parts by at least one line of perforation. One part is a negotiable instrument intended to be severed from the document along the line of perforation. Another part is a product information label. The document is folded into a plurality of overlying panels by fold lines with a least a portion of the product information label forming an outer panel. The clear upper layer is attached to at least a part of the document's outer panel and both oppositely disposed edges of the base layer, thereby attaching the document to the base layer and enclosing the document between the upper layer and the base layer.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 illustrates a perspective view of a preferred form of a label in accordance with the invention before being opened.

FIG. 2 shows a perspective view of the label after it is opened, but before a negotiable instrument disposed therein has been unfolded.

FIG. 3 shows a perspective view of the opened label after the negotiable instrument disposed therein has been unfolded.

FIG. 4 shows a perspective view of the label after the negotiable instrument has been severed from the label.

FIG. 5 shows a side view of the unopened label taken along axis line 5—5 of FIG. 1.

FIG. 6 is a top or plan view of the opened label with an unfolded negotiable instrument, taken along axis line 6—6 of FIG. 3.

FIG. 7 is a view of the reverse side of the negotiable instrument.

DESCRIPTION OF THE PREFERRED EMBODIMENT

While the invention will be described in connection with a preferred embodiment, it will be understood that it is not intended to limit the invention to that embodiment. On the contrart, it is intended to cover all alternatives, modifications and equivalents as may be included within the spirit and scope of the invention as defined by the appended claims.

Apparatus depicting the preferred embodiments of the novel packaging label are illustrated in the drawings.

The term "negotiable instrument" in this invention is meant to include an unconditional promise or order to pay a fixed amount of money. It includes checks, money orders and the like. Thus, it is clearly distinguished from other forms of enticement material such as coupons (both rebate and cents-off) and other "mail-in" type offers. These other forms of promotional material do not in all cases place in the customer's hands an instantly valuable instrument that can be redeemed through regular banking channels and at little inconvenience to the customer.

FIG. 1 shows a perspective view of an exemplary label which incorporates therein the novel features. Label 10 is comprised of three discrete parts, base layer 12, strip 14 which includes a folded negotiable instrument 16 and panel 18 (serving as a product information label), and top layer 20. Strip 14 is typically, but not necessarily, of paper. When joined together as described, the three discrete parts form a single, unitary structure which is affixed to a container (not shown).

Base layer 12 has length $L_1$ and width $W_1$. Adhesion to the container is by way of the backing of the base layer 12 (not shown) which can be any form of pressure sensitive backing, as is well-known in the art. Before application of the label 10 to a container, the label 10 in FIG. 1 form may be stored on wax-coated or plastic-coated release paper. The label 10 can then be easily peeled off the release paper, exposing the pressure sensitive backing. Since the backing of base layer 12 does not form any part of the invention and is well-known in the label-affixing art, no further description has been provided. Base layer 10 is opaque so as to allow for printing of product information thereon, as described below.

FIG. 1 also shows strip 14 after it has been folded up to form panels (to be further described below) and placed on top of base layer 12. The width of the folded strip 14, $W_2$, is slightly shorter than the width of the base layer, $W_1$. The folded strip 14 is centered widthwise with respect to the base layer 12. Although the length of the strip 14, $L_2$, is depicted as being identical to the length of the base layer, $L_1$, it should be recognized that the length dimensions are not critical. $L_1$ could be greater than $L_2$, thereby exposing a portion of the base layer. The outwardly facing side of panel 18 of strip 14 comprises a product information label. The remainder of the strip 14 is the negotiable instrument 16. In the preferred embodiment, the product information label is formed from a portion of one of the panels of the strip 14. A bar code label 22 is preferably disposed on the panel 18. Thus, the product information label on panel 18 can contain all pertinent information related to the container in which it is affixed.

Lastly, FIG. 1 shows top layer 20 having a main portion 24 which overlies panel 18, and oppositely disposed edge portions 26 which overlie the base layer 12. Thus, the top layer 20 has substantially the same width as the base layer 12 (discounting the slightly increased width caused by the thickness of the folded strip 14). The length of the top layer 20 is preferably similar to the length of the strip 14 so as to ensure that the entire length of the panel 18 side edges are adhered to the base layer 12 and to create a smooth and flush outer label surface. In the preferred embodiment, top layer 20 is a clear adhesive material, such as clear tape. Thus, the top layer 20 provides a lamination-type protection for panel 18, while simultaneously attaching the folded up strip 14 to base layer 12.

FIG. 2 depicts the label 10 after it has been opened, but before the negotiable instrument 16 disposed therein has been unfolded. A purchaser of the container containing label 10 is instructed (by appropriate directions preprinted on panel 18) to sever the top layer 20 along the edge which seals the edge of the strip 14 to base layer 12. In the exemplary embodiment, the right edge is severed. The left edge remains intact. It is unnecessary to remove the left edge in order to gain access to the negotiable instrument 16. It should also be evident that if the left edge was severed and the right edge was left intact, the negotiable instrument 16 could not be accessed. It should be recognized that the manner in which the strip 14 is folded will determine which edge should be severed.

FIG. 3 depicts the opened label 10 after the negotiable instrument 16 disposed therein has been unfolded. This view reveals a series of fold lines 28 which define a plurality of panels 30. The sum of the individual panels 30 comprise the negotiable instrument 16. As the customer unfolds the negotiable instrument 16, the inwardly facing side of panel 18 will be visible and can be used to provide additional indicia. For example, the indicia may thank a customer for buying the container and may indicate that the negotiable instrument is a "Real Check". Instructions for cashing the check and/or completing questionnaire information may also be provided. Also visible in this view is perforation 32 and product information portion 36 disposed on the outwardly facing side of the opaque base layer 12, as will be further described with respect to FIG. 4. Additional panels, with or without perforation lines, could be provided that would contain one or more additional valuable documents such as cents-off coupons.

FIG. 4 depicts label 10 after the negotiable instrument 16 has been severed from the label 10 along the perforation 32. As noted above, the outwardly facing side of base layer 12 includes product information portion 36. This portion 36 is disposed between the portions of the base layer 12 overlaid by the edge portions 26 of the top layer 20. The product information portion 36 can be similar to the product information label on panel 18. Thus, when the customer after purchase removes the negotiable instrument, the container would still have affixed to it product information. This is important when label 10 partially or completely obscures the original labeling when label 10 is affixed to a container. In the depicted embodiment, bar code label 22 is not printed on product information portion 36. The absence of a bar code label from the container alerts a cashier or store personnel that label 10 has been tampered with, thereby serving as a built-in tamper evident feature.

In the depicted embodiment, the negotiable instrument 16 is pre-endorsed and can be made payable to the "Bearer". Thus, if the negotiable instrument is a check, the customer can cash it through normal banking channels. Alternatively, the cashier or store can cash the check for the purchasing customer on the spot. The store would then negotiate it through normal banking channels.

In another embodiment, the negotiable instrument is a "coupon check" made payable to the "Retailer". In this version, the customer would receive a discount if he removes the check and completes the questionnaire and hands it over to the retailer. The retailer would then negotiate the check through normal banking channels. To entice the customer to cooperate in completing the questionnaire and transferring the check (which, being payable to "Retailer", is not negotiable by the customer) to the retailer, the retailer would provide a discount or rebate to the customer for the face amount of the check.

Preferably, the back of the negotiable instrument (shown in FIG. 7) contains a product survey questionnaire to be filled out by the customer.

FIG. 5 depicts a side view of the unopened label 10 taken along axis line 5—5 of FIG. 1. This view shows the three parts, base layer 12 with pressure sensitive backing 34, strip 14 which includes a folded negotiable instrument 16 and panel 18, and top layer 20 with main portion 24 and oppositely disposed edge portions 26.

FIG. 6 depicts the opened label 10 with an unfolded negotiable instrument 16, taken along axis line 6—6 of FIG. 3. Once opened, panel 18 covered by the transparent main portion 24 of the top layer 20 forms a flap. The main portion 24 of top layer 20 has been severed from the right edge portion 26 while the left edge portion 26 remains attached to the top layer 20.

FIG. 7 depicts the back of negotiable instrument 16, showing a form of questionnaire disposed thereon to be filled out by the customer. The questionnaire preferably includes both boxes to check pre-printed answers and blank spaces to write in other answers or to answer questions without pre-printed answers. This form of questionnaire makes it possible to ask open-ended questions and does not limit the respondent to YES/NO answers. When the redeemed negotiable instrument makes its way back to the issuing bank through the payor, the answers to the product survey questionnaire are available to the payor and are used to collect market data from purchasers of the products to which the negotiable instrument was affixed. It has been found that the return rate is remarkably high, on average 50 percent, and about 95 percent of returned checks have completed questionnaires due to the customer perception that the questionnaire must be filled out to properly redeem the negotiable instrument. In contrast, the very low redemption rates of coupons and the like, typically below 10 percent, makes these enticement vehicles unsuitable for efficient collection of survey data.

It should be noted that the strip 14 could be any form of a foldable document. It could even fold out in more than one direction. It is only required that, once folded, it fits between base layer 12 and top layer 20 and can be fully accessed by severing only one edge of the top layer 20. It is also contemplated that one edge of the top layer 20 could be of a peel-and-stick type adhesive so that this edge could be repeatedly attached and detached without destroying the integrity of the label. In this alternative construction, access to the foldable document would require only detaching the peel-and-stick edge.

Also, as noted above, additional printed indicia such as coupons or other customer enticements could be included in the strip 14 or foldable document. Additional perforation lines could alternatively be made in order to allow for easy removal of such enticements.

The novel label has other possible uses. The label could serve as a purchase enticement vehicle. The three-dimensional nature of the multi-layer label provides a visible, physical indication to the customer that the purchase of a particular product will include some form of a bonus. Alternatively, enticement indicia on the outer panel or visible edges of the base layer (e.g., "Instantly Redeemable Check Enclosed Inside") could explicitly communicate that the purchase comes with a valuable negotiable instrument. If such checks are made payable to the "Bearer", they can serve as instant rebate checks. Furthermore, the label could be used as a sole packaging label, thereby minimizing product container preparation costs. In this manner, the label would serve the dual purpose of identifying products, providing a negotiable instrument therein redeemable upon purchase of the product, and still provide product identification information if a portion of the label (e.g., strip 14) is removed.

The novel packaging label described above provides significant advantages not contemplated by prior art packaging labels and questionnaire checks. This label expands the channels whereby questionnaire checks can be used. Virtually any product container can now be used as a delivery system for such checks without concern for any unintentional obscuring of the container's original label. Furthermore, the label is designed to alert the customer or store personnel that label tampering has occurred.

The present invention may be embodied in other specific forms without departing from the spirit or essential attributes thereof and, accordingly, reference should be made to the appended claims, rather than to the foregoing specification, as indicating the scope of the invention.

I claim:

1. A label for affixing to a container comprising:

(a) an opaque base layer having an adhesive side for affixing to the container and an imprinting side for printing indicia thereon, the imprinting side having oppositely disposed edges flanked by a product information portion;

(b) a longitudinally foldable strip having a perforation running perpendicular to the longitude, the perforation separating the strip into two parts, one part being a negotiable instrument intended to be severed from the strip along the perforation and the other part being a product information label, the strip being folded into a plurality of overlying panels by fold lines with at least a portion of the product information label forming an outer panel, the folded strip overlying the opaque base layer's product information portion; and (c) a transparent top layer permanently attached to at least a part of (i) the strip's outer panel; and (ii) both oppositely disposed edges of the base layer, thereby attaching the strip to the base layer and enclosing the strip between the top layer and the base layer, the transparent top layer being severable along one edge so as to allow access to the negotiable instrument.

2. The label of claim 1 wherein the negotiable instrument includes negotiable indicia on one side and questionnaire information on its opposite side.

3. The label of claim 1 wherein the product information portion and the product information label contain substantially similar information for ensuring that product information remains affixed to the container upon removal of at least the product information label part of the strip from the base layer.

4. The label of claim 3 wherein the product information label includes a product identifying bar code, the absence of the bar code from the product information portion indicating the removal of at least the product information label part of the strip from the base layer.

5. The label of claim 1, wherein the negotiable instrument is a check.

6. A negotiable instrument delivery system and label comprising:

(a) an opaque base layer having an adhesive side for affixing to the container and an imprinting side for printing indicia thereon, the imprinting side having oppositely disposed edges flanked by a product information portion;

(b) a foldable document overlying the base layer's product information portion, the foldable document being separated into at least two parts by at least one line of perforation, one part being a negotiable instrument intended to be severed from the document along the line of perforation and another part being a product information label, the document being folded into a plurality of overlying panels by fold lines with a least a portion of the product information label forming an outer panel;

(c) a clear upper layer attached to at least a part of (i) the document's outer panel; and (ii) both oppositely disposed edges of the base layer, thereby attaching the documents to the base layer and enclosing the document between the upper layer and the base layer.

7. The negotiable instrument delivery system and label of claim 6 wherein the document is folded so as to allow access to the negotiable instrument by detaching only one edge of the upper layer from an edge of the base layer.

8. The negotiable instrument delivery system and label of claim 6 wherein the negotiable instrument includes negotiable indicia on one side and questionnaire information on its opposite side.

9. The negotiable instrument and label of claim 6 wherein the product information portion and the product information label contain substantially similar information for ensuring that product information remains affixed to the container upon removal of both parts of the document from the base layer.

10. The negotiable instrument and label of claim 9 wherein the product information label includes a product identifying bar code, the absence of the bar code from the product information portion indicating the removal of at least the product information label part of the document from the base layer.

11. The label of claim 6, wherein the negotiable instrument is a check.

* * * * *